US012766397B2

(12) United States Patent
Brown

(10) Patent No.: US 12,766,397 B2
(45) Date of Patent: Oct. 20, 2026

(54) SPLIT END SECTION GUY WIRE SYSTEM FOR VOLLEYBALL AND BADMINTON SETS

(71) Applicant: Jesse Brown, Kirkland, WA (US)

(72) Inventor: Jesse Brown, Kirkland, WA (US)

( * ) Notice: Subject to any disclaimer, the term of this patent is extended or adjusted under 35 U.S.C. 154(b) by 579 days.

(21) Appl. No.: 18/217,271

(22) Filed: Jun. 30, 2023

(65) Prior Publication Data

US 2025/0001278 A1 Jan. 2, 2025

(51) Int. Cl.
*A63B 71/02* (2006.01)
*A63B 61/02* (2006.01)

(52) U.S. Cl.
CPC ..... *A63B 71/021* (2013.01); *A63B 61/02* (2013.01); *A63B 2243/0095* (2013.01)

(58) Field of Classification Search
CPC ..... A63B 61/02; A63B 71/021; A63B 2243/0095
See application file for complete search history.

(56) References Cited

U.S. PATENT DOCUMENTS 4,720,112 A * 1/1988 Stettner ..... A63B 71/021 473/492
5,326,109 A * 7/1994 Robl ..... A63B 69/0095 473/492
5,333,880 A * 8/1994 Allbright ..... A63B 71/021 473/493
5,885,176 A * 3/1999 Wong ..... A63B 71/021 473/490
7,455,603 B2 * 11/2008 Bouffard ..... A63B 63/004 473/492
2014/0243119 A1 * 8/2014 Whalen ..... A63B 61/02 473/493

FOREIGN PATENT DOCUMENTS

CN 202892837 U * 4/2013
EP 4186570 A1 * 5/2023 ..... A63B 63/083

* cited by examiner

*Primary Examiner* — Audrey B. Walter
(74) *Attorney, Agent, or Firm* — Larsen IP PLLC; James C. Larsen

(57) ABSTRACT

A guy wire system for supporting a volleyball or badminton net having a split two-part end section, each part attachable to the ground.

6 Claims, 3 Drawing Sheets

SPLIT END SECTION GUY WIRE SYSTEM FOR VOLLEYBALL AND BADMINTON SETS

TECHNICAL FIELD

This invention relates generally to the sports of volleyball and badminton, in particular outdoor volleyball and badminton, and more specifically concerns guy wire arrangements for volleyball and badminton nets.

BACKGROUND OF THE INVENTION

Volleyball and badminton nets are attached to supporting end poles, from which guy wires extend outwardly and are secured to the ground. However, traditional guy wire arrangements are unstable, as the attachments to the ground become loose or release during volleyball or badminton action, requiring frequent re-staking to the ground to maintain a tight net. This is a disadvantage of volleyball and badminton play. Further, using longer stakes is disadvantageous when play is at parks with hard ground and the stakes cannot be driven flush, leaving a top portion exposed. This is a safety hazard. This invention is directed toward providing a stable and safe attachment to the ground surface from the supporting end poles of the volleyball and badminton net.

SUMMARY OF THE INVENTION

Accordingly, the invention is a guy wire system for supporting a volleyball or badminton net with end poles, comprising: at least one guy wire attachable at a first end thereof to one of the volleyball or badminton net end poles, with a second end thereof extending outwardly therefrom, including a split end section attachable to the ground and at least one guy wire attachable at a first end thereon to the other end pole, with a second end extending outwardly therefrom, including a split end section attachable to the ground.

BEST MODE FOR CARRYING OUT THE INVENTION

Figure 1:
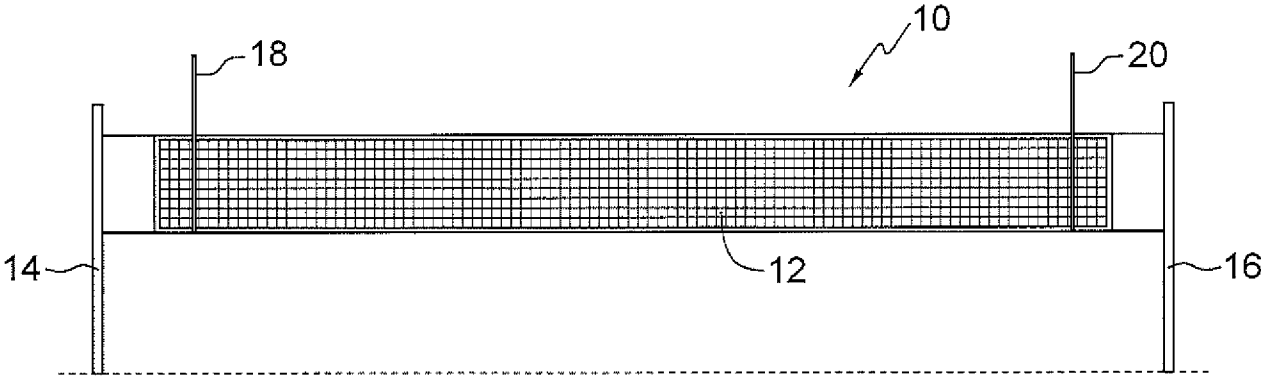
FIG. 1 (PRIOR ART)
FIG. 1 is an elevational view showing a conventional volleyball or badminton net assembly with guy wire support end poles.

FIG. 1 illustrates at 10 a conventional outdoor volleyball net assembly. The volleyball net assembly includes a traditional volleyball net 12, supported by two supporting end poles 14 and 16 which are typically hollow. Typically, the net is approximately 32" wide. When supported at the poles, the center height of a volleyball net is approximately 8' for men and 7'4" for women. Badminton nets are set at 5'. Typically, the two supporting end poles 14 and 16 are approximately 8'4" high when used for men's volleyball and 7'8" for women's volleyball and 5'4" when used for badminton. When tensioned, support guywires from the poles will provide a downward force on the poles to achieve a desired finished net height. Taller poles are needed to accommodate for the ground being compacted. The net itself is approximately 39" for volleyball and 2'6" for badminton. The nets are constructed with a polyester polypropylene or nylon netting with a mesh size of 4" for volleyball and ½" for badminton, capped with a head band along the perimeters. The opposing ends of the head bands are attached to the two poles. The assembly also includes two antennas 18 and 20 when used for competition volleyball, which adds weight to the net, requiring more net tension to maintain a tight net.

The supporting end poles are conventionally stabilized by two guy wires (not shown in FIG. 1) which extend from the top of each pole and angle outwardly, attached to the ground by stakes or cleats, as discussed above. Second guy wires are sometimes used, extending from approximately a mid-point of each pole outwardly, to reduce deflection in the hollow poles with their ends again being secured to the ground by stakes or cleats. The angle between the two upper guy wires is typically in the range of 45-90 degrees.

Figure 2:
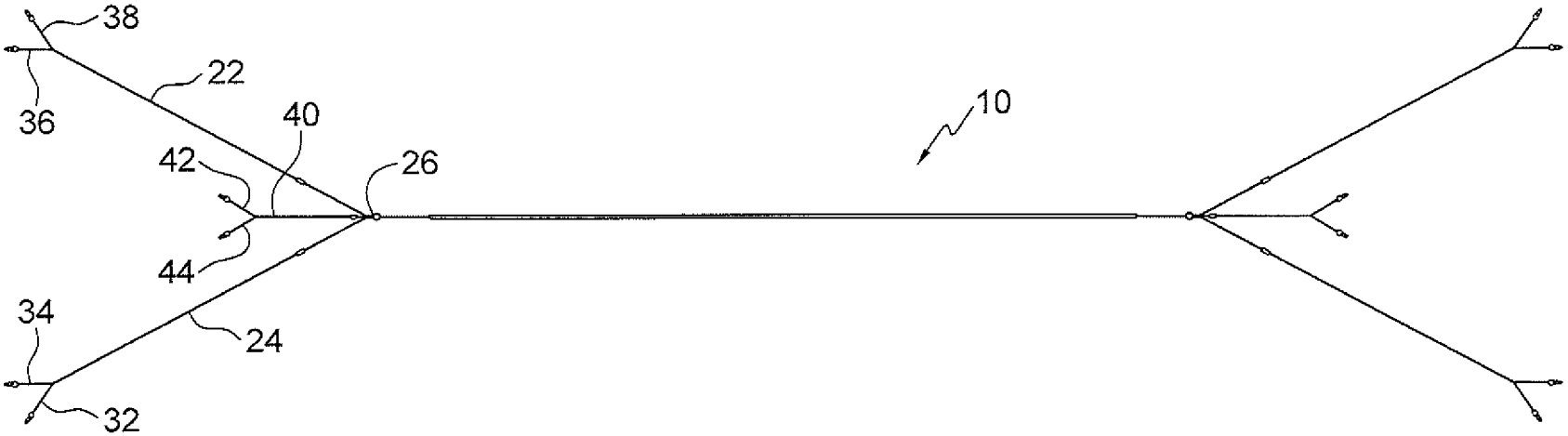
FIG. 2 is a top view of the guy wire arrangement of the present invention with a volleyball/badminton net and supporting poles.
Figure 3:
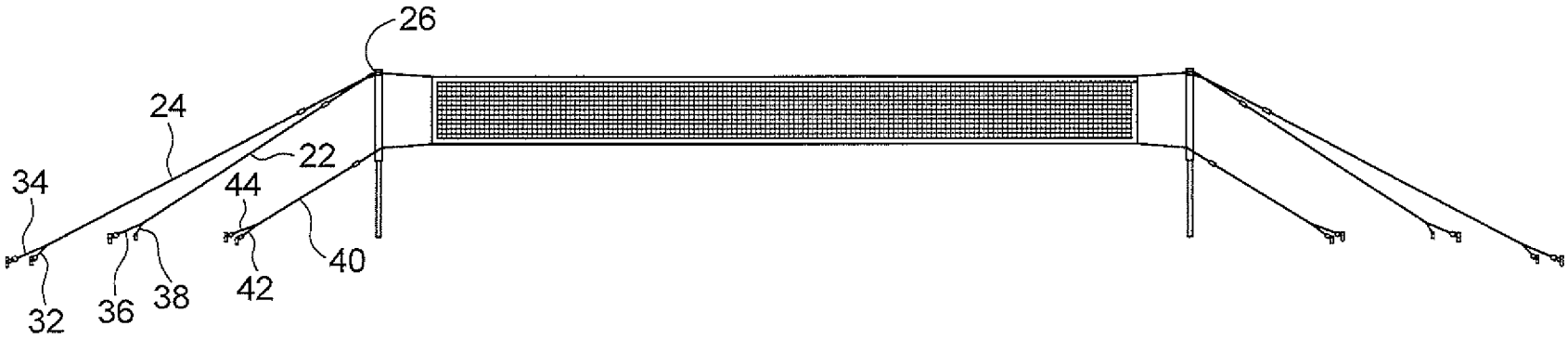
FIG. 3 is an elevational view of the guy wire arrangement of FIG. 2.

The present invention, shown in FIGS. 2 and 3, include two angled guy wires 22 and 24 from the top of each end pole 26 (only one end designated), which split into two divergent split end sections 32 and 34 for guy wire 24, and 36 and 38 for guy wire 22, each of which end sections is separately attached to the ground by a stake or cleat. In the present invention, the angle between the two guy wires from their attachment at the top of the supporting end pole to the split end sections is approximately in the range of 45-90 degrees, while the split end sections also have an angle of approximately in the range of 45-90 degrees therebetween. An additional single guy wire 40 extends from the end pole 26, which also splits into two divergent end sections 42 and 44, with an angle in the range of 45-90 degrees.

In the embodiment shown, the guy wires to the split end sections are approximately 96-144 inches long, although this can vary, while the split end sections are approximately 6-12 inches, although this can vary as well. Each split end section is separately secured to the ground by a tie or latch, aiding significantly in the stability of the supporting end poles, resisting the guy wires coming loose from the ground, maintaining the tightness of the net, which is important for proper play, while also being flush with the ground, maintaining safety.

While the preferred embodiment includes two split end sections at the end of each single guy wire, it should be understood that other arrangements could be used as well, including three, four or even more individual split end sections can be used for one or each guy wire.

Again, this arrangement has the significant advantage in stabilizing the volleyball and badminton supporting end poles and hence the volleyball or badminton net, even under rigorous use conditions, while maintaining safety of the recurring elements.

Although a preferred embodiment of the invention has been disclosed for purposes of illustration, it should be understood, that various changes, modifications, and substitutions may be incorporated in the embodiment without departing from the spirit of the invention, which is defined by the claims which follow.

What is claimed is:

1. A guy wire system for supporting a volleyball or badminton net with end poles at respective ends of the net, the system comprising:

for each end pole, at least one guy wire having a first end attachable at a top portion of a respective one of the end poles, and a second end extending away from said each end pole, the second end of each guy wire including a split end section having at least two distal ends each independently attachable to the ground.

2. The system of claim 1, wherein each split end section includes at least two parts having an angle therebetween.

3. The system of claim 1, further including, for each distal end of each split end section of the at least one guy wire, a tie or latch for connecting each distal end to the ground.

4. The system of claim 1, wherein the split end section of one or more of the at least one guy wire includes more than two distal ends for connection with the ground.

5. The system of claim 1, wherein the at least one guy wire for each of the volleyball or badminton net end poles includes two guy wires for each end pole, each of the two guy wires attachable via its respective first end to the top portion of the same end pole, the two guy wires separated by a selected angle.

6. The system of claim 5, further comprising, for at least one of the end poles, an additional guy wire attached, at a first end thereof, at approximately a midpoint of the at least one end pole, the additional guy wire including, at a second end thereof, a split end section.

* * * * *